United States Patent [19]

Wang

[11] 4,312,554

[45] Jan. 26, 1982

[54] ELECTRIC SAFETY SOCKET WITH INTERNAL LOCKING MEANS

[76] Inventor: Wei-Kung Wang, No. 14, Alley 3, La. 61, Yen Chiy Yuan Rd., Sec. 2, Nan Kang District, Tai Pai, Taiwan

[21] Appl. No.: 116,715

[22] Filed: Jan. 30, 1980

[51] Int. Cl.[3] ..... H01R 13/54

[52] U.S. Cl. ..... 339/74 R

[58] Field of Search ..... 339/74, 82, 253

[56] References Cited

U.S. PATENT DOCUMENTS 3,828,300 8/1974 Codrino ..... 339/74 R 3,942,856 3/1976 Mandheim ..... 339/74 R

*Primary Examiner*—Joseph H. McGlynn

*Attorney, Agent, or Firm*—Ladas & Parry

[57] ABSTRACT

An electric socket with locking means inside; when the plug is inserted into it, the electrical source will be connected, and at the same time, the plug will be locked. To disconnect the plug, a button must first be pushed to release the locking means and disconnect the electrical source. This construction will be very safe because there is no way to contact the electrical source from the socket either with the plug inserted or without the plug inserted. When it is connected, accidental disengagement of the plug and disconnection of the electrical source will not occur.

5 Claims, 5 Drawing Figures

ELECTRIC SAFETY SOCKET WITH INTERNAL LOCKING MEANS

BACKGROUND OF THE INVENTION

The present invention relates to an electric socket, and more particularly to a safety socket having an internal locking means which will retain the plug in a locked position with good electrical contact when the plug is inserted into the socket so as to prevent the plug from being removed by accident.

A conventional electrical contact clip of a socket is ordinarily formed of a metal strip in the general shape of a "U" with inwardly extending jaws to provide a gap to receive when in use an electrical contact blade of the plug. The gap will become widened due to metal fatigue resulting in loss of the elastic properties of the metal, and there will no longer be a friction fit between the inwardly extending jaws and the plug blade. Once the friction fit is lost, electrical contact can no longer be maintained and the clip must be repaired or replaced.

Briefly, the present invention overcomes the disadvantages of prior sockets by providing a socket with internal locking means comprising a laterally movable member having a pair of spaced bars which can be shifted into holes in the blades of the plug when the plug is inserted into the socket in order to avoid disconnecting the electrical source and can be retained in an unlocked position by means of spring retainers so as to release the plug.

Accordingly, it is an object of the present invention to provide a safety socket with internal locking means which will retain a plug in a locked position with good electrical contact when the plug is inserted into the socket so as to avoid disconnection of the electrical source when an undesired pulling force is applied to the lead wire of the plug, and will retain the bar in a concealed position when the plug is removed from the socket so as to prevent anyone from contacting the electrical source.

Other objects and advantages of this invention will be readily apparent from the following description wherein reference is made to the accompanying drawings.

DETAILED DESCRIPTION OF THE INVENTION

Figure 1:
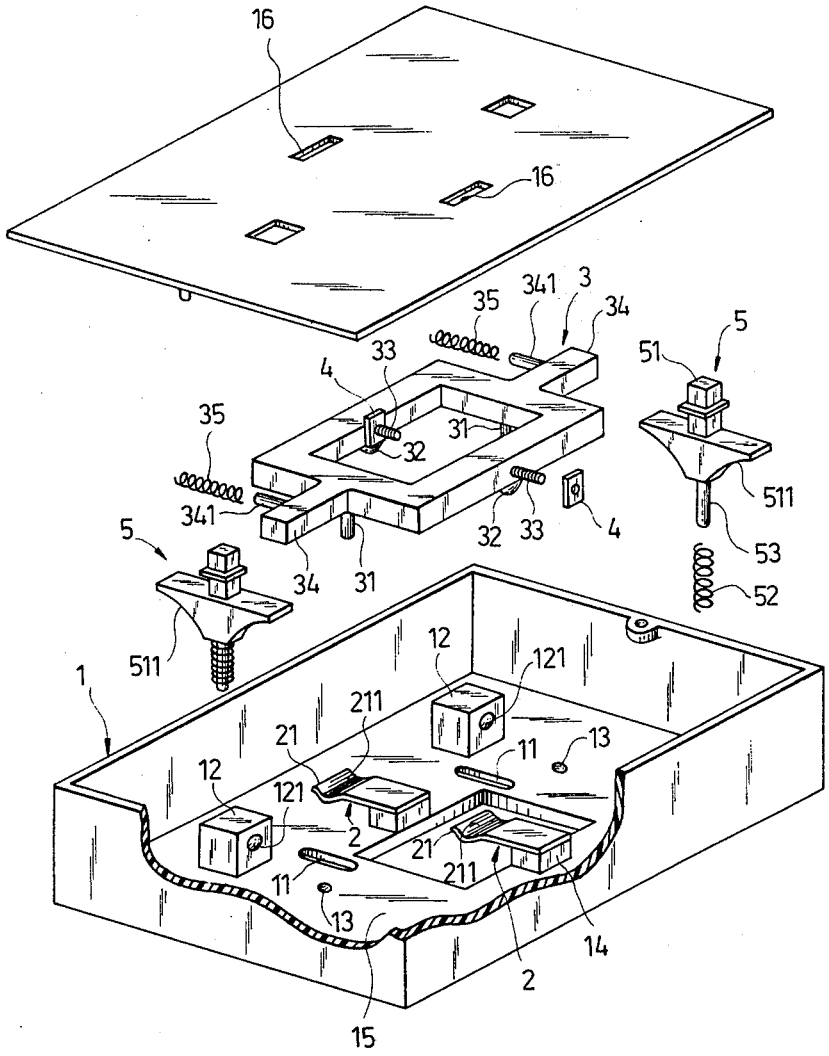
FIG. 1 is an exploded perspective view of an electric safety socket in accordance with the present invention.
Figure 2:
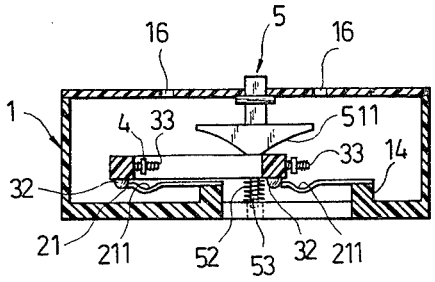
FIG. 2 is a longitudinal sectional view of the socket of FIG. 1.
Figure 3:
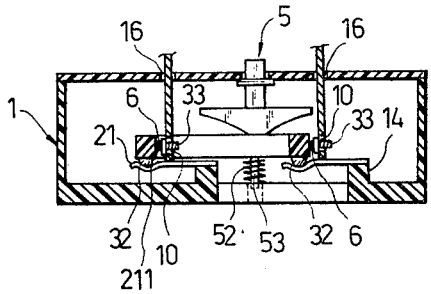
FIG. 3 is a longitudinal sectional view of the socket of FIG. 1 with plug blades inserted, along line III—III of FIG. 4.
Figure 4:
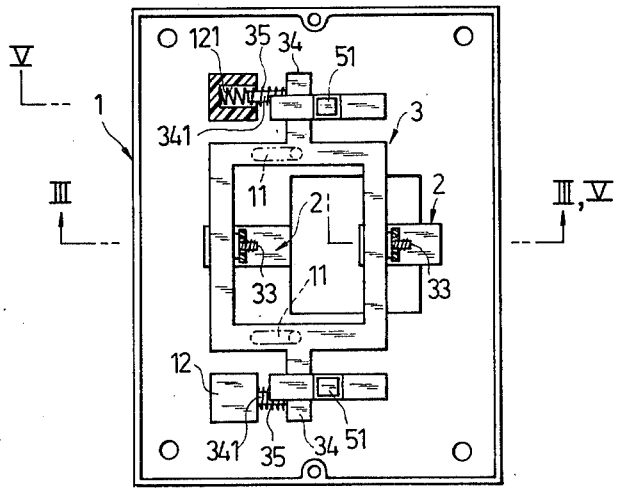
FIG. 4 is a top plan view of the socket of FIG. 1.

Referring now to FIGS. 1, 2 and 4, the safety socket of this invention includes an insulated casing 1, a pair of spring retainers 2, an insulated laterally movable member 3, a pair of contact members 4, and a pair of actuators 5. The spring retainers 2 are arranged in spaced position on the bottom 15 of the casing 1, and are formed of a metal strip having suitable elastic properties, one end of which is secured at a distance from the bottom of the casing 1 by means of a spacer 14, in order that the other end 21 can be moved downwardly. The end 21 has a concave depression 211 for receiving a hemispherical projection 32 on the laterally movable member 3. The laterally movable member 3 is arranged in the casing 1 above the retainers 2, the casing being made from plastic material in the shape of a rectangular frame. A pair of spaced downwardly protruding guide rods 31 are integrally formed on the laterally movable member 3 and are received in respective lateral elongated slots 11 in the bottom of the casing in order that the laterally movable member may be positionally guided during movement thereof. A pair of bars 33 are also integrally formed on the laterally movable member 3, one of which extends inwardly on the left side of the laterally movable member 3 at the intermediate portion thereof. Each bar 33 is provided with threads for threaded engagement with its respective contact member 4. The contact members 4 are plates made from alloys of copper and bronze and are provided with a threaded hole at the center thereof for engagement with its respective bar 33 in order to provide a terminal 6 for the electrical source between the side of the laterally movable member 3 and each contact member 4 as shown in FIG. 3.

The front and rear sides of the laterally movable member 3 each has an integral extension 34 and each extension is provided with a lateral guide rod 341 at the left side thereof for sliding engagement with a lateral slide hole 121 in the guide seat 12 as shown in FIG. 4.

A helical compression spring 35 is located in each slide hole 121, and extends between the inner end of the hole 121 and the extension 34 so that the spring 35 will be compressed by the laterally movable member 3 when it is moved relatively to the spring 35. Member 3 will be retained in position by the end 21 of the spring retainer 2.

A pair of actuators 5 are provided adjacent to the left and right sides of the extensions 24 respectively; they comprise a push button 51 with a compression spring 52. The push button 51 has an elongated extension 511 having the cross section of a trapezoid at its intermediate portion, and has a guide rod 53 which is received in a hole 13 in the bottom 15 of the casing 1 and extends through the compression spring 52 which is located between the elongated portion 511 and the bottom 15 of the casing 1.

Figure 5:
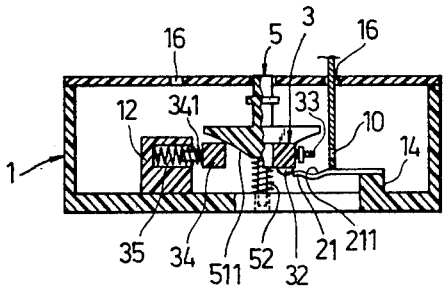
FIG. 5 is a longitudinal sectional view of the socket of FIG. 1 with the plug blades inserted, along line I—I of FIG. 4.

Referring now to FIGS. 2, 3 and 5, when the plug is inserted into the socket, the spring retainers 2 will be pressed and slightly moved downwardly by the ends of the contact blades of the plug to release retention of the hemispherical projections 32 whereby the laterally movable member 3 is shifted rightwardly by means of the resilient force of the springs 35; the bars 33 may then be inserted into the holes in the contact blades, and the contact members 4 which are connected with the contact bars 33 can be brought into good electrical contact with the contact blades of the plug. For the removal of the plug, when either of the push buttons is pushed, as illustrated in FIG. 5, the extension 34 of the laterally movable member will be forced to the left by the slope of the elongated portion 511, and the hemispherical projection 32 will be moved away from the concave depression 211 at the end 21 and will be retained in position by the outer edge of the end 21; the bars 33 will also be moved out of the holes in the contact blades of the plug and will return to their original unlocked position, when the plug may then be easily removed.

From the above description it can be seen that once the plug is inserted into the socket, the plug is locked in good electrical contact position due to the face that the bars 33 have been inserted into the holes in the contact blades, and cannot be moved away; hence accidental removal of the plug or accidental disconnection of the electrical source could not occur during use. Once the plug is removed from the socket, the bars 33 return to their original unlocked position and are spaced away from the centerline of the holes 16 into which the contact blades of the plug are to be inserted; therefore they cannot be touched by anyone from outside even though a wire should be inserted in the socket by children.

What is described in one embodiment of the invention. In this embodiment, the two bars 33 are moved simultaneously. One modification of this embodiment would be that the two bars are moved independently, and only one of them is locked if the laterally movable member 3 is divided into two parts. Another simple modification would be that the locking means engages a hole in the third ground terminal contact balde of the plug, while the conducting blades of the plug may be constructed as bars or other shapes. The holes in the blades of the plug may instead be recessed while the laterally movable members 3 of the socket are constructed as bars that will fit into the recesses to lock the plug from moving. The actuators 5 of this invention may also be coupled with temperature sensitive or current sensitive devices to reject the plug when the electric current is too great. A further simple modification would be that the spring retainers 2 are made from ordinary metal strip, and a coil spring extends between the spring retainers and the bottom of the casing in order to provide a spring back effect.

What is claimed is:

1. An electric safety socket with internal locking means, comprising an insulated casing (1), an insulated laterally movable member (3) having a pair of spaced bars (33) for insertion into the contact blades of a plug in a locked position by means of a spring in order that a pair of contact members (4) arranged on said contact bars (33) can be brought into engagement with said contact blades when said plug is inserted into the socket, a pair of spring retainers (2) for retention of said laterally movable member (3) in unlocked position, and a pair of actuators (5) for movement of said laterally movable member.

2. A safety socket with internal locking means as claimed in claim 1, wherein said contact members (4) are plates having an enlarged area for engagement with said contact blades of the plug.

3. A safety socket with internal locking means as claimed in claim 1, wherein said actuators (5) have an enlongated extension (511) formed with the cross section of a trapezoid at the intermediate portion thereof.

4. A safety socket with internal locking means as claimed in claim 1, wherein said bars (33) are inserted into holes in the contact blades of the plug.

5. A safety socket with internal locking means as claimed in claim 1, wherein said contact members (4) are removably mounted on said bars (33) by thread means.

* * * * *